US009868190B2

(12) United States Patent
Yang et al.

(10) Patent No.: US 9,868,190 B2
(45) Date of Patent: Jan. 16, 2018

(54) RATCHET WRENCH

(71) Applicants: Chun-Wei Yang, Taichung (TW); Zhe-Ping Zhang, Taichung (TW)

(72) Inventors: Chun-Wei Yang, Taichung (TW); Zhe-Ping Zhang, Taichung (TW)

(73) Assignees: ZHE JIANG YIYANG TOOL MANUFACTURE CO., LTD., Zhe Jiang (CN); CHUN-WEI YANG, Zhe Jiang (CN); ZHE-PING ZHANG, Zhe Jiang (CN)

( * ) Notice: Subject to any disclaimer, the term of this patent is extended or adjusted under 35 U.S.C. 154(b) by 271 days.

(21) Appl. No.: 14/691,574

(22) Filed: Apr. 21, 2015

(65) Prior Publication Data

US 2016/0311088 A1 Oct. 27, 2016

(51) Int. Cl.
*B25B 13/46* (2006.01)
*B25G 1/00* (2006.01)

(52) U.S. Cl.
CPC ..... *B25B 13/465* (2013.01); *B25B 13/467* (2013.01); *B25G 1/005* (2013.01)

(58) Field of Classification Search
CPC ..... B25B 13/465; B25B 13/467; B25G 1/005
See application file for complete search history.

(56) References Cited

U.S. PATENT DOCUMENTS 4,147,801 A * 4/1979 Lenhard ..... A61K 31/185 436/821
4,545,267 A * 10/1985 Shumway ..... B25B 13/467 81/57.29
5,058,463 A * 10/1991 Wannop ..... B25B 13/467 81/57.26
6,070,499 A * 6/2000 Wisbey ..... B25B 13/467 81/57.29
6,311,584 B1 * 11/2001 Chu ..... B25B 13/465 81/57.29
6,457,386 B1 * 10/2002 Chiang ..... B25B 13/465 81/57.29
6,925,910 B2 * 8/2005 Alford ..... B25B 13/465 81/57.29
7,267,033 B1 * 9/2007 Lai ..... B25B 13/465 81/57.29

* cited by examiner

*Primary Examiner* — Joel Crandall

(57) ABSTRACT

A ratchet wrench includes a body, a driving unit, a control unit, a first rotary unit, a second rotary unit and a second connector. The body has a first recess and a restriction portion. The driving unit is connected to the working end of the body and is driven by the control unit to allow the wrench to be rotated clockwise or counter clockwise. The first rotary unit has a first rotary rod, a third toothed ring, a sleeve, a first clip, a second resilient member and a bead. The second rotary unit has a second rotary rod, two caps, a second resilient member, a third rotary rod and a handle. The second connector is located in the restriction portion. The second connector is located corresponding to the groove of the first rotary rod, so that the first rotary rod does not drop from the first recess.

14 Claims, 12 Drawing Sheets

A-A

E

C

B

A-A

E

A-A

C

F-F

G

RATCHET WRENCH

BACKGROUND OF THE INVENTION

1. Fields of the Invention

The present invention relates to a ratchet wrench, and more particularly, to a safe and easy-to-use ratchet wrench.

2. Descriptions of Related Art

The conventional wrench disclosed in U.S. Pat. No. 6,311,584 discloses a handle including a first end having a head formed thereon. The head includes an internal gear formed therein. The handle includes a bore formed therein and communicates with the internal gear. At least one ring gear is rotatably received in the head. A bevel gear is rotatably received in the bore of the handle and engaged with the at least one ring gear for rotating the at least one ring gear in either direction. A seat is rotatably received in the head and includes a driving stem extended therefrom. A pair of pawls are rotatably secured to the seat and each include two ends for selectively engaging with the internal gear. At least one rod engaged between the at least one ring gear and the seat to selectively drive the seat with the at least one ring gear. There is a means for rotating the bevel gear to rotate the at least one ring gear with the at least one rod. However, the handle and the axle are not well secured so that the handle may shift from the axle when in use.

The present invention intends to provide a ratchet wrench which improves the shortcomings mentioned above.

SUMMARY OF THE INVENTION

The present invention relates to a ratchet wrench and comprises a body, a driving unit, a control unit, a first rotary unit, a second rotary unit and a second connector. The body has a first recess and a restriction portion. The driving unit is connected to the working end of the body and is driven by the control unit to allow the wrench to be rotated clockwise or counter clockwise. The first rotary unit has a first rotary rod, a third toothed ring, a sleeve, a first clip, a second resilient member and a bead. The second rotary unit has a second rotary rod, two caps, a second resilient member, a third rotary rod and a handle. The second connector is located in the restriction portion. The second connector is located corresponding to the groove of the first rotary rod, so that the first rotary rod does not drop from the first recess.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
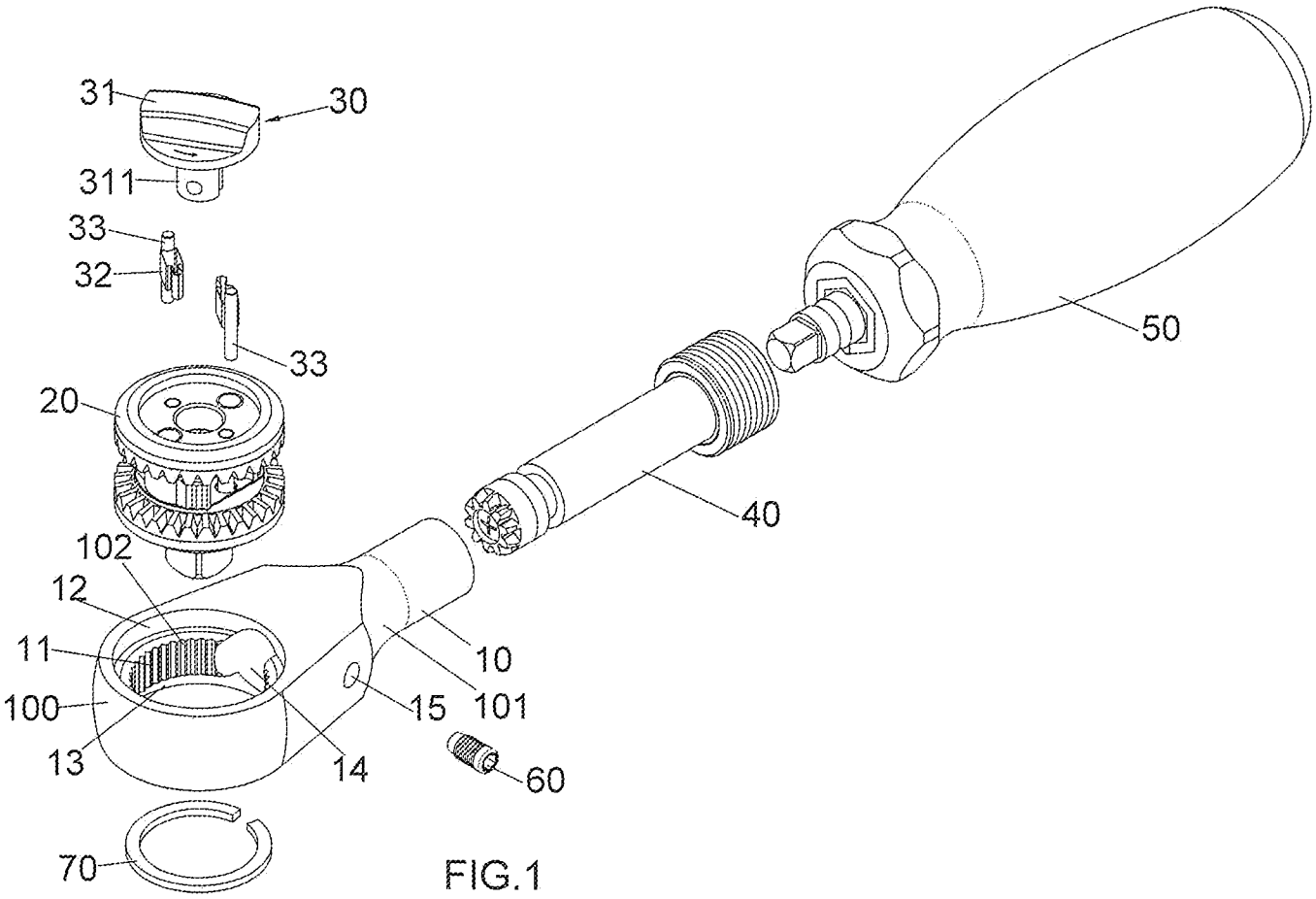
FIG. 1 is an exploded view to show the ratchet wrench of the present invention.
Figure 2:
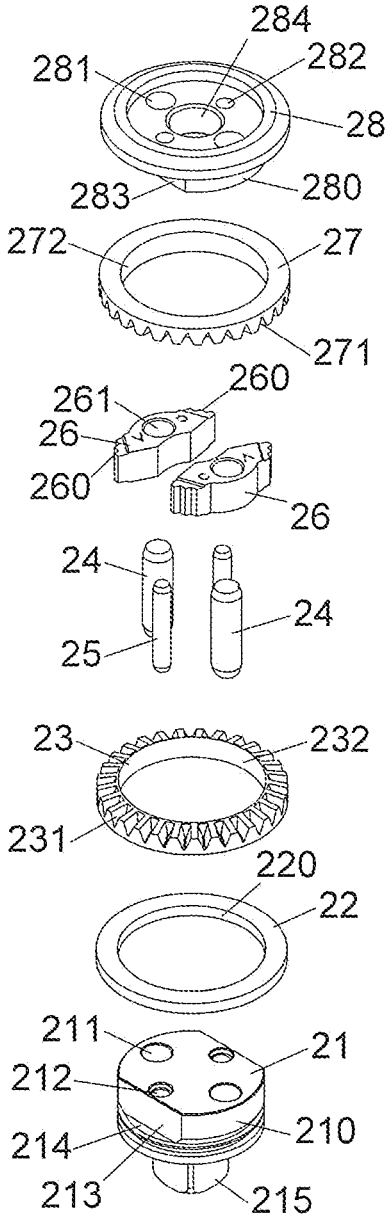
FIG. 2 is an exploded view to show the driving unit of the ratchet wrench of the present invention.
Figure 3:
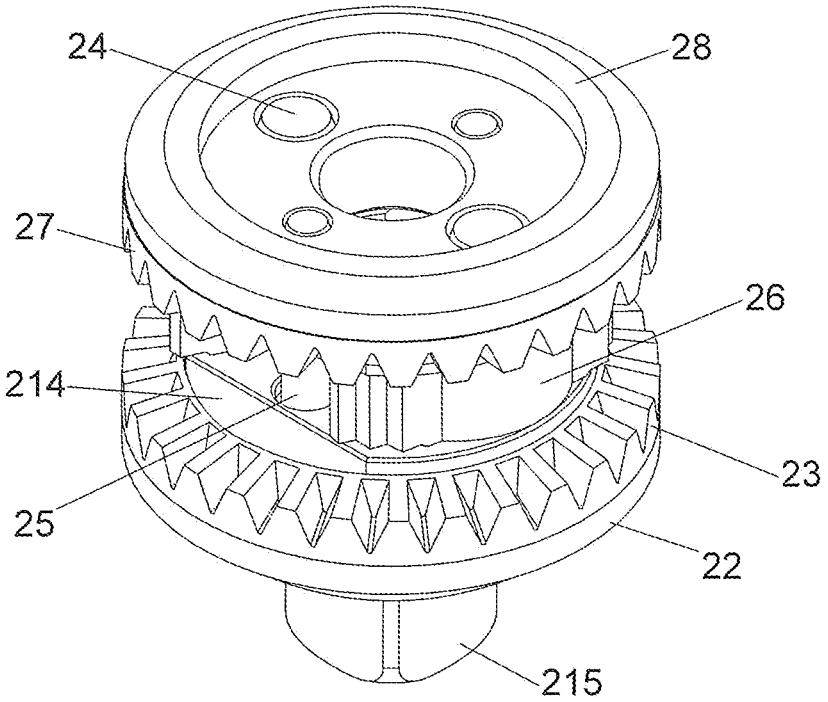
FIG. 3 is a perspective view of the driving unit of the ratchet wrench of the present invention.
Figure 5:
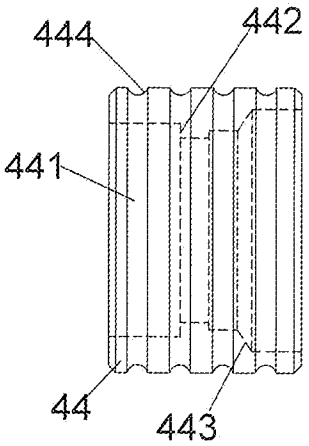
FIG. 5 shows the sleeve of the first rotary unit of the ratchet wrench of the present invention.

Referring to FIGS. 1 to 6, the ratchet wrench of the present invention comprises a body 10, a driving unit 20, a control unit 30, a first rotary unit 40, a second rotary unit 50, a second connector 60 and a second clip 70.

The ratchet wrench comprises an elongate body 10 having an extension 101 which has a working end 100 on one end thereof. The working end 100 has a through hole 102 which has a first toothed portion 11 defined in the inner periphery thereof. A first space 12 and a second space 13 are respectively and co-axially located on the top and the bottom of the through hole 102. The diameter of the first space 12 and the diameter of the second space 13 are larger than that of the first toothed portion 11. The extension 101 has a first recess 14 defined axially therein which communicates with the first toothed portion 11. The body 10 having a restriction portion 15 defined in one side thereof and the restriction portion 15 communicates with the first recess 14.

The driving unit 20 is rotatably located in the through hole 102 of the working end 100, and comprises a cylindrical lower part 21, an annular seat 22, an annular first toothed ring 23, two first rods 24, two second rods 25, two first pawls 26, an annular second toothed ring 27 and a cylindrical top part 28. The lower part 21 has two first connection portions 211 and two second connection portions 212. The two first connection portions 211 and the two second connection portions 212 are upright holes. The diameter of the first connection portion 211 is larger than that of the second connection portion 212. The lower part 21 has two first faces 213 which are flat faces and located on two opposite sides of the lower part 21. The lower part 21 is a rectangular driving portion 215 so as to be connected with socket, extension rod or an universal connector. The seat 22 is mounted to the lower part 21. The inner diameter of an inner periphery 220 of the seat 22 is the same as that of the lower part 21. The outer diameter of the seat 22 is larger than that of the lower part 21. The first toothed ring 23 is mounted to the lower part 21 and rested on the seat 22. The first toothed ring 23 has first teeth 231 defined in the outer periphery thereof. The inner periphery 232 of the first toothed ring 23 faces the first faces 213 so as to form two rooms 214 defined by the two first faces 213 and the inner periphery 232 of the first toothed ring 23. The first rods 24 are inserted in the first connection portions 211. The first rods 24 are two cylindrical rods, and the second rods 25 are inserted in the second connection portions 211. The second rods 25 are cylindrical rods. The two first pawls 26 are symmetrically connected to the top of the lower part 21 and each of the two first pawls 26 has engaging teeth 260 which are engaged with the first toothed portion 11. Each of the two first pawls 26 has a first hole 261. The first rod 24 extends through the first hole 261. The second toothed ring 27 has second teeth 271 which are located corresponding to the first teeth 231 of the first toothed ring 23. The second toothed ring 27 has a second inner periphery 272. The top part 28 is located corresponding to the lower part 21. The second toothed ring 27 is mounted to the outer surface 280 of the top part 28. The top part 28 has two third connection portions 281 and two fourth connection portions 282. The third connection portions 281 and the two fourth connection portions 282 are respectively located corresponding to the first connection portions 211 and the second connection portions 212. The two third connection portions 281 are mounted to the first rods 24. The two fourth connection portions 282 are mounted to the second rods 25. The top part 28 has two second faces 283 located on two opposite sides thereof, and the two second faces 283 are located corresponding to the first faces 213. The top part 28 has a second hole 284 defined centrally therethrough.

The control unit 30 for controlling the driving unit 20 to rotate clockwise or counter clockwise comprises a switch 31, two first resilient members 32 and two pins 33. The switch 31 has a cylindrical switch rod 311 which is pivotably connected to the second hole 284. The switch rod 311 has a recessed portion defined in each of two sides thereof. The top of the switch 31 protrudes from the body 10. Each first resilient member 32 is pivotably connected to the second rod 25 corresponding thereto. The first resilient member 32 has one end pivotably connected to the switch rod 311. Each of the first resilient members 32 has a protruding end and an open end. Each of the pins 33 is engaged with the open end of the first resilient member 32 corresponding thereto. The pin 33 is located in the room 214 of the lower part 21. One end of each pin 33 is located between the first face 213 and the inner periphery 232 of the seat 22, and the other end of each pin 33 is located between the second inner periphery 272 and the second face 283. When the switch 31 is rotated to pivot the first pawl 26 about the first rod 24, and to drive the first resilient member 32, the first resilient member 32 moves the pin 33 within the room 214 so as to control the rotational direction of the ratchet wrench.

The first rotary unit 40 comprises a first rotary rod 41 with a round cross section, a ring-shaped third toothed ring 42, a first connector 43, a sleeve 44, a C-shaped first clip 45, a second resilient member 46 and a bead 47. The first rotary rod 41 is pivotably located in the first recess 14 and has a non-circular protrusion 411 extending from the first end thereof. A connection end 412 with inner threads is defined in the end face of the protrusion 411. A non-circular first reception recess 414 is defined in the second end of the first rotary rod 41. The first rotary rod 41 has a groove 413 defined in the outside thereof, and the groove 413 of the first rotary rod 41 is located corresponding to the restriction portion 15. A second reception recess 415 is defined in the second end of the first rotary rod 41 and communicates with the first reception recess 414. A bead receiving hole 416 and another groove 417 are defined in the outside of the first rotary rod 41. The bead receiving hole 416 is located corresponding to the second reception recess 415. Said another groove 417 is located corresponding to the first reception recess 414. The third toothed ring 42 is mounted to the protrusion 411 and has a third toothed portion 421 on one end thereof. The third toothed portion 421 is located between the first teeth 231 and the second teeth 271. The third toothed portion 421 is engaged with the first teeth 231 and the second teeth 271. The first connector 43 extends through the third toothed ring 42 and has outer threads which are threadedly connected to the connection end 412. The sleeve 44 is axially mounted to the first rotary rod 41 and moved between a release position and an engaged position. The sleeve 44 has a receiving recess 441 defined therein which extends through the first open end of the sleeve 44. A stepped recess 443 is defined in the second end of the sleeve 44 and communicates with the receiving recess 441. The stepped recess 443 is wider from the first end toward the second end of the sleeve 44. The stepped recess 443 is located corresponding to the second reception recess 415. A shoulder 442 is formed in the sleeve 44 and located between the stepped recess 443 and the receiving recess 441. The sleeve 44 has multiple ridges 444 for increasing friction. The first clip 45 is engaged with said another groove 417 and located within the receiving recess 441. The outer periphery of the first clip 45 protrudes from the outer surface of the first rotary rod 41. The first clip 45 is in flush with the sleeve 44. The second resilient member 46 is mounted to the first rotary rod 41 and located within the receiving recess 441. The second resilient member 46 is biased between the shoulder 442 and the first clip 45 so that the second resilient member 46 provides a force move the sleeve 44 between the release position and the engaged position. The bead 47 is a spherical bead and located in the bead receiving hole 416 and is restricted by the stepped recess 443 so as not drop from the bead receiving hole 416. The bead receiving hole 416 has a lip which prevents the bead 47 from dropping into the second reception recess 415. The first rotary unit 40 has an annular end piece 48 which is mounted to the first rotary rod 41 and located between the first rotary rod 41 and the stepped recess 443. The end piece 48 seals an open end of the stepped recess 443. The end piece 48 is in flush with the second end of the first rotary rod 41.

The second rotary unit 50 having a second rotary rod 51 which has a non-circular cross section, two caps 52, a third resilient member 53, a third rotary rod 54 which has a non-circular cross section and a handle 55. The second rotary rod 51 has a first reception portion 511 and a second reception portion 512 on the first end thereof. The second reception portion 512 is a cylindrical portion. A hole 514 is defined transversely through a second end of the second rotary rod 51. The first reception portion 511 is shaped to be matched with the first reception recess 414. The first reception portion 511 is engaged with the first reception recess 414. The second reception portion 512 is received in the second reception recess 415. Preferably, the first reception recess 414 is a rectangular recess, and the first reception portion 511 is a rectangular protrusion. Alternatively, the first reception recess 414 is a hexagonal recess, the first reception portion 511 is a hexagonal protrusion. The second reception portion 512 has a groove 513 which is located corresponding to the bead receiving hole 416. The bead 47 is engaged with the groove 513 of the second reception portion 512. The second rotary rod 51 is restricted by the bead 47 to engage the second reception portion 512 with the second reception recess 415. The third resilient member 53 and the two caps 52 are located in the hole 514 of the second rotary rod 51. The third resilient member 53 is biased between the two caps 52, and the two caps 52 partially protrude from two ends of the hole 514 of the second rotary rod 51. The third rotary rod 54 has a first passage 541 defined through two open ends thereof. The cross section of the first passage 541 is matched with the cross section of the second rotary rod 51. The first passage 541 is to be engaged with the second end of the second rotary rod 51. The third rotary rod 54 has two holes 542 defined along the third rotary rod 54. The holes 542 in the third rotary rod 54 are circular holes. The hole 514 of the second rotary rod 51 is located corresponding to one of the holes 542 in the third rotary rod 54 so that the caps 52 are engaged with the holes 542 of the third rotary rod 54 so as to adjust the position of the third rotary rod 54 relative to the second rotary rod 51. The handle 55 has a second passage 551 defined in one end thereof. The cross section of the third rotary rod 54 is matched with the cross section of the second passage 551. One end of the third rotary rod 54 is to be engaged with the second passage 551. The second connector 60 is connected to the restriction portion 15 and movably engaged with the groove 413 of the third rotary rod 41. Preferably, each of the second and third rotary rods 51, 54 has a hexagonal cross section, and the first and second passages 541, 551 each are a hexagonal passage. The second connector 60 restricts the first rotary rod 41 from dropping from the first recess 14. A C-shaped second clip 70 is mounted to the lower part 21 to prevent the driving unit 20 from dropping the body 10.

Figure 7:
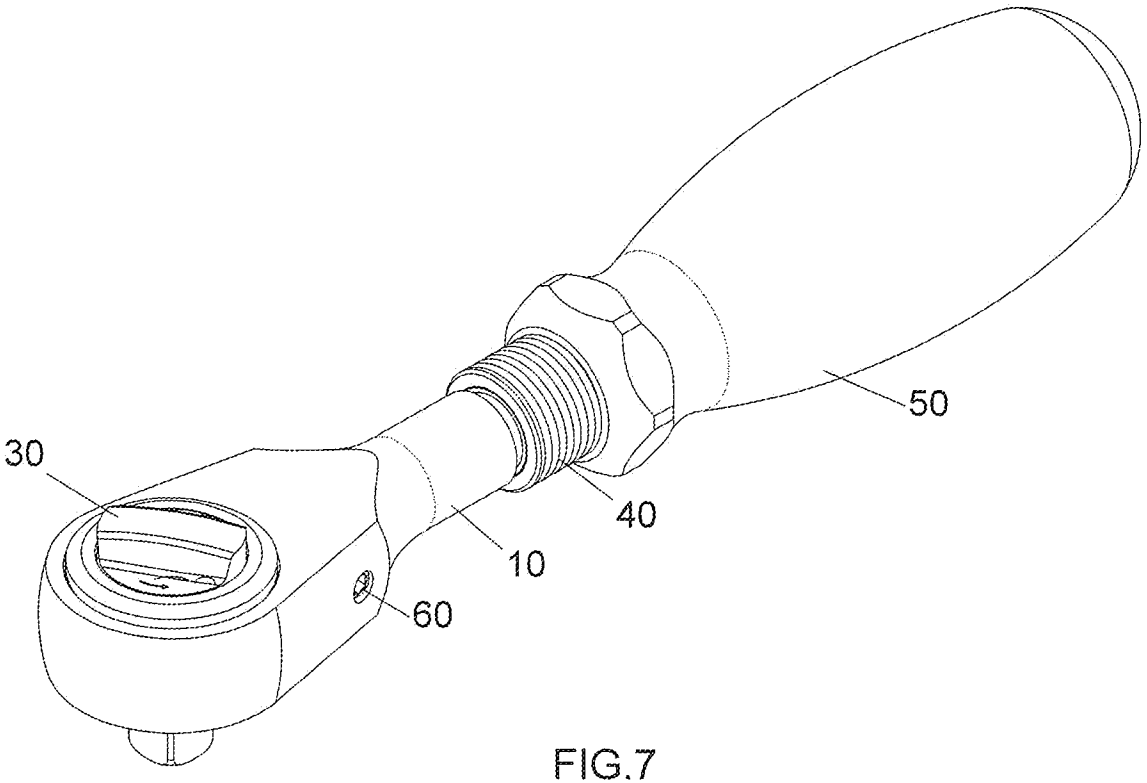
FIG. 7 is a perspective view to show the ratchet wrench of the present invention.
Figure 8:
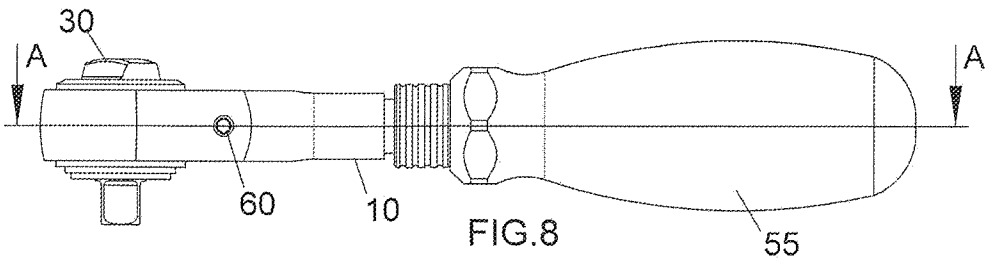
FIG. 8 is a side view to show the ratchet wrench of the present invention.
Figure 9:
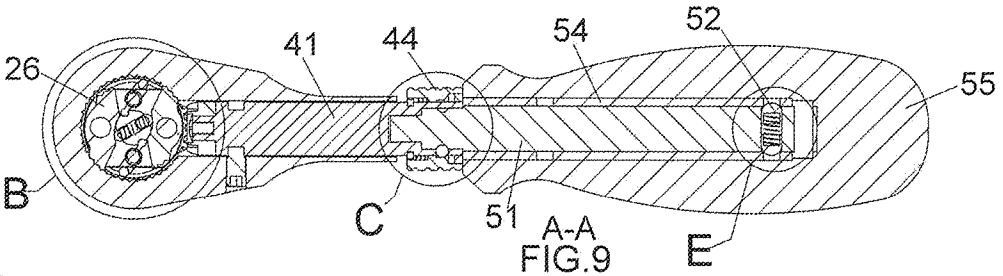
FIG. 9 is a cross sectional view, taken along line A-A in FIG. 8.
Figure 10:
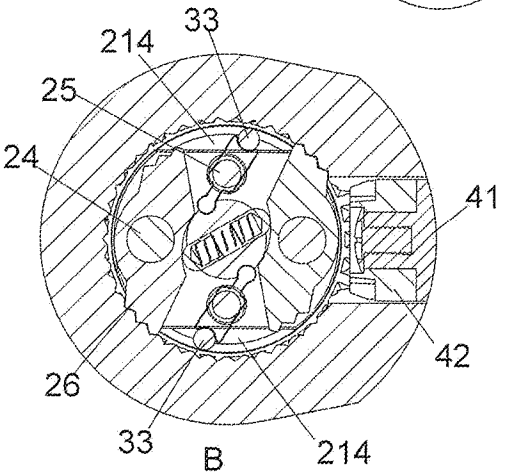
FIG. 10 shows an enlarged view in the circled portion B in FIG. 9.

As shown in FIG. 7, the driving unit 20 is located in the through hole 102 of the working end 100. The first and second rotary units 40, 50 are connected to each other. As shown in FIGS. 8 to 10, the first rod 24 is connected to the first and third connection portions 211, 281. The first rod 24 extends through the first hole 261. The second rod 25 is connected to the second and fourth connection portions 212, 282. The engaging teeth 260 of the first pawls 26 are engaged with the first toothed portion 11. Each of the pins 33 is engaged with the protruding end of the first resilient member 32 corresponding thereto. The two pins 33 are located in the space between the first contact faces 213, the inner periphery 232 of the seat 22, the second inner periphery 272 and the second contact faces 283. The third toothed ring 42 is located on the first end of the first rotary rod 41.

Figure 11:
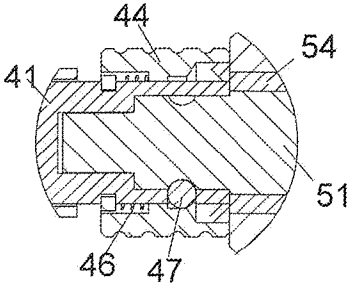
FIG. 11 shows an enlarged view in the circled portion C in FIG. 9.

As shown in FIG. 11, when the sleeve 44 is located at the engaged position, the bead 47 is pushed by the stepped recess 443 inward to be engaged with the groove 513. The second rotary rod 51 is restricted by the bead 47 and positioned at a specific position relative to the first rotary rod 41.

Figure 12:
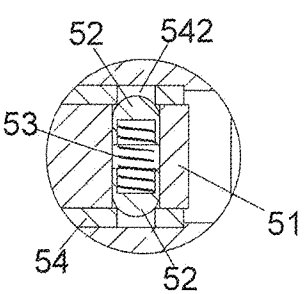
FIG. 12 shows an enlarged view in the circled portion E in FIG. 9.

As shown in FIG. 12, the second rotary rod 51 is inserted into the first passage 541, the third rotary rod 54 is inserted in the second passage 551. The two caps 52 are biased by the third resilient member 53 to engage with the hole 542 so that the third rotary rod 54 is positioned at a specific position relative to the second rotary rod 51.

Figure 13:
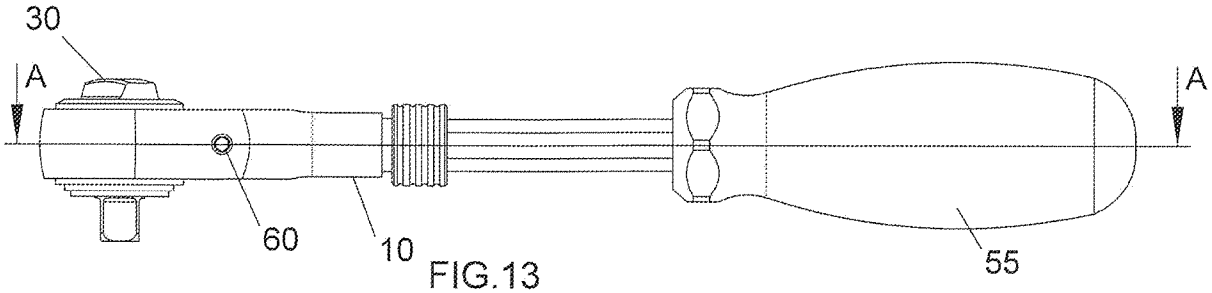
FIG. 13 is a side view to show that the second rotary rod is pulled.
Figure 14:
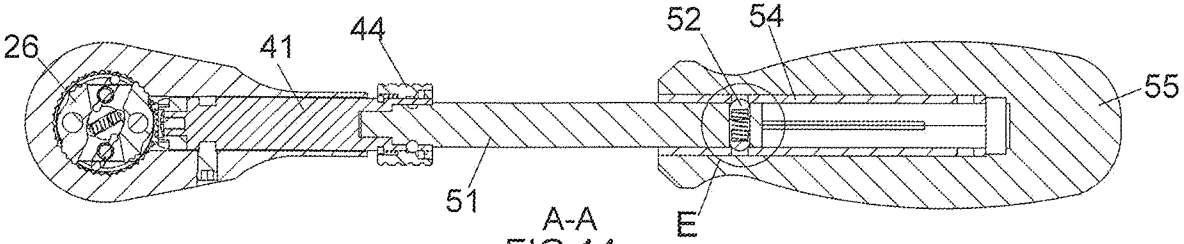
FIG. 14 is a cross sectional view, taken along line A-A in FIG. 13.
Figure 15:
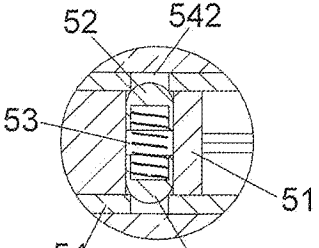
FIG. 15 shows an enlarged view in the circled portion E in FIG. 14.

As shown in FIGS. 13 to 15, when the handle 55 is pulled backward, the handle 55 moves the third rotary rod 54 move, and the two caps 52 are moved inward by the movement of the hole 542. The two caps 52 are then biased by the third resilient member 53 to engaged with the hole 542 of the third rotary rod 54. Therefore, the second and third rotary rods 51, 54 are connected to each other to form a fixed length.

Figure 16:
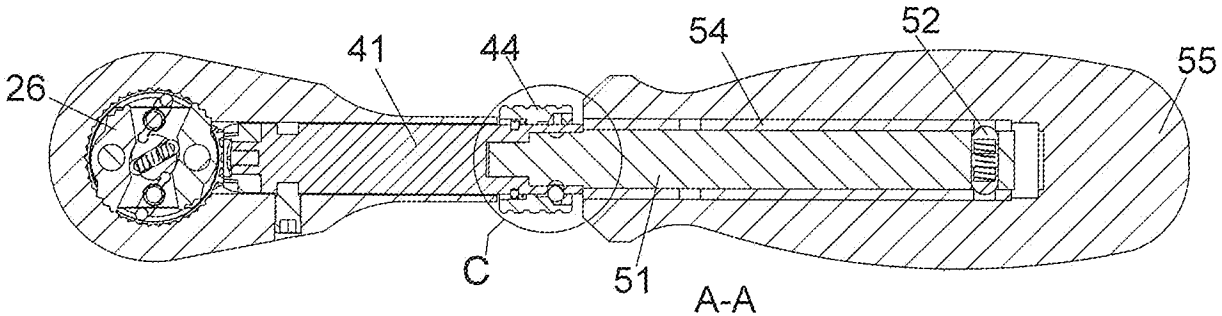
FIG. 16 is a cross sectional view to show that the first and second rotary units are separated from each other.
Figure 17:
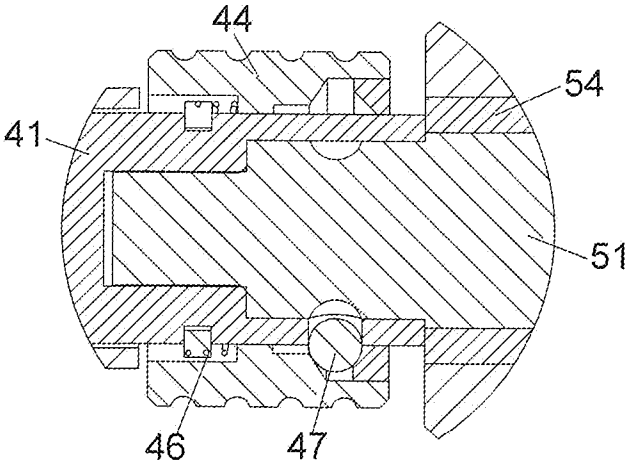
FIG. 17 shows an enlarged view in the circled portion C in FIG. 16.

As shown in FIGS. 16 and 17, the sleeve 44 is axially moved along the first rotary rod 41 to the release position and the engaged position. When the user pushes the sleeve 44 toward the driving unit 20 and reaches the release position, the second resilient member 46 is compressed. The larger inner diameter portion of the stepped recess 443 accommodates the bead 47. When the groove 513 of the second rotary rod 51 is moved, the bead 47 moves outward to disengage from the groove 513 of the second rotary rod 51 to let the second and first rotary rods 51, 41 be free of restriction.

Figure 18:
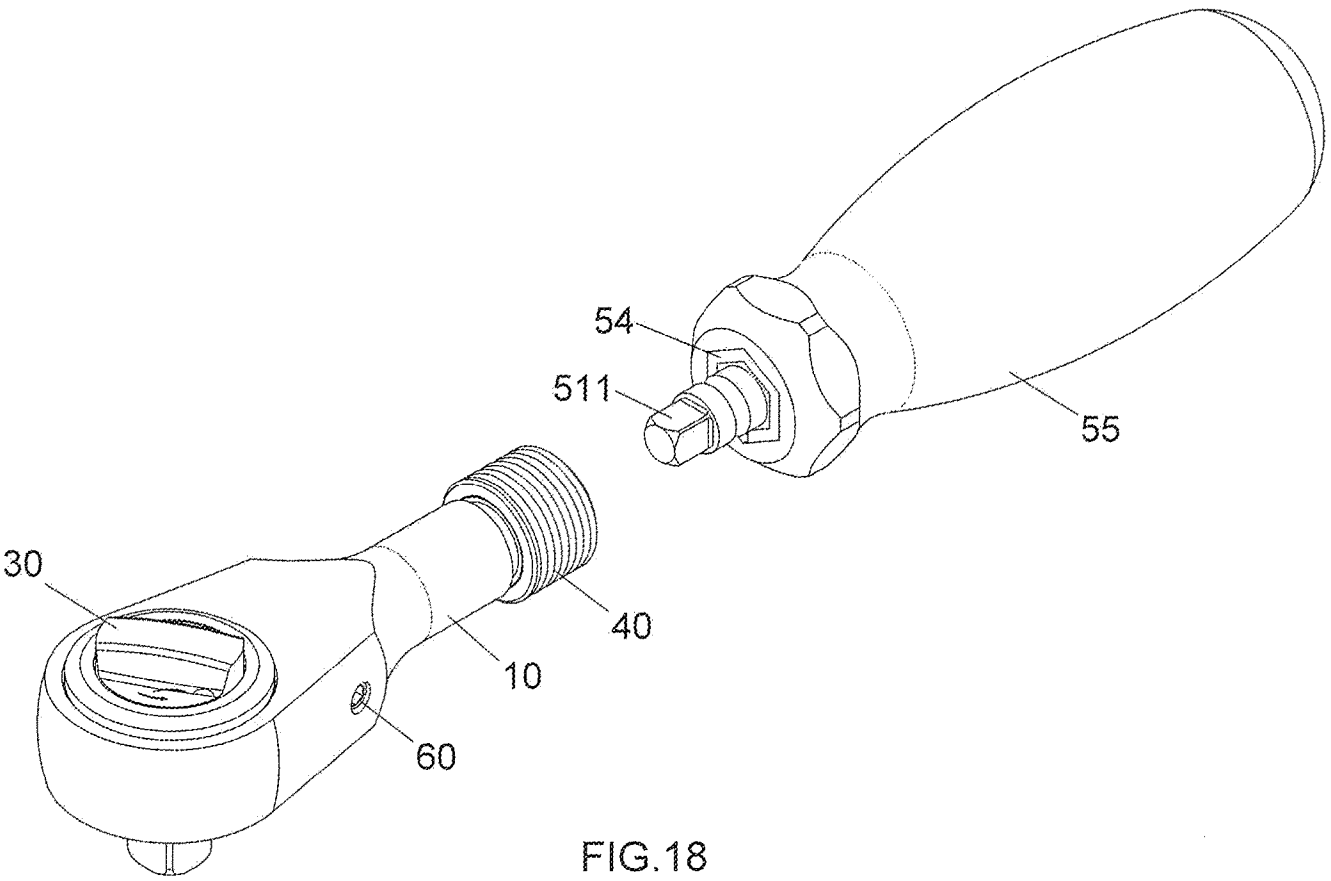
FIG. 18 is a perspective view to show that the first and second rotary units are separated from each other.

As shown in FIG. 18, when the sleeve 44 is moved toward the driving unit 20 and reaches the release position, the second and first rotary rods 51, 41 are separated from each other. The first reception portion 511 protrudes so as to drive other tools.

Figure 19:
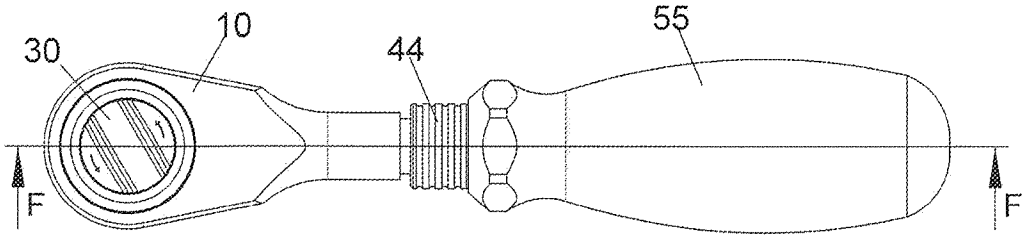
FIG. 19 is a top view to show that the second rotary unit is rotated.
Figure 20:
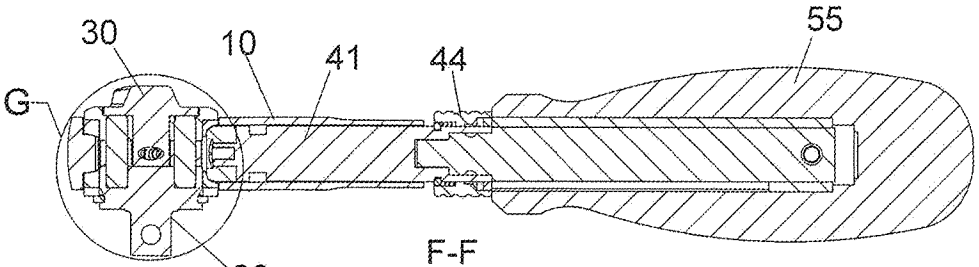
FIG. 20 is a cross sectional view, taken along line F-F in FIG. 19.
Figure 21:
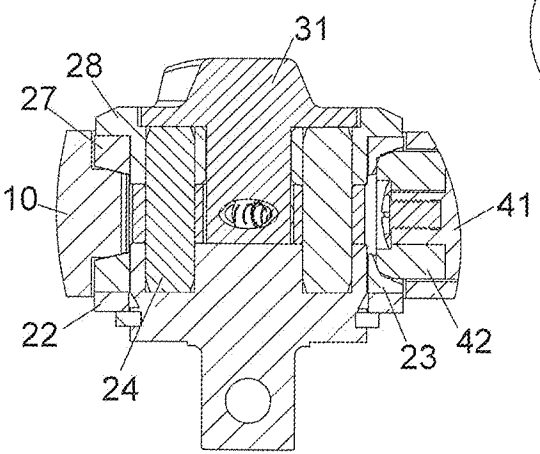
FIG. 21 shows an enlarged view in the circled portion G in FIG. 20.

As shown in FIGS. 19 to 21, the user may drive the handle 55 to rotate 360 degrees, the handle 55 drives the third rotary rod 54, the second rotary rod 51, the first rotary rod 41 and the third toothed ring 42 to rotate. As shown in FIG. 10, the third toothed ring 42 rotates and drives the first toothed ring 23, the second toothed ring 27, the pins 33 of the control unit 30 and the driving unit 20 to rotate 360 degrees, so that the driving portion 215 of the lower part 21 drives another hand tool.

Figure 4:
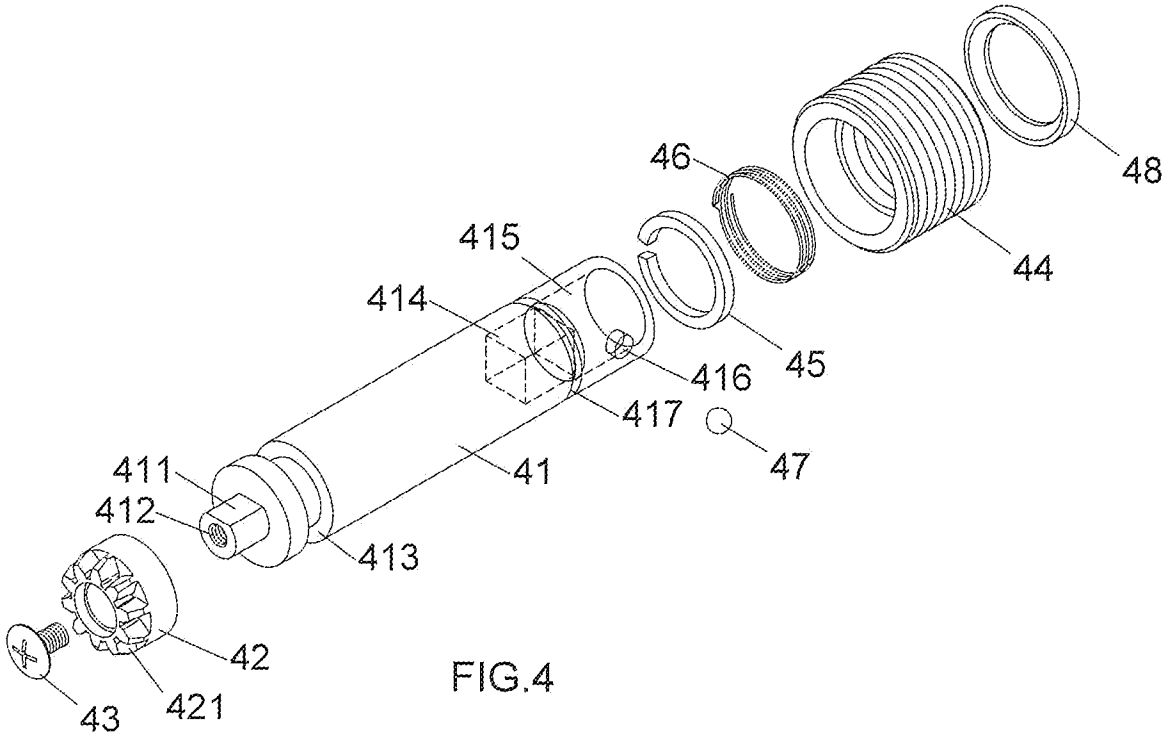
FIG. 4 is an exploded view to show the first rotary unit of the ratchet wrench of the present invention.
Figure 6:
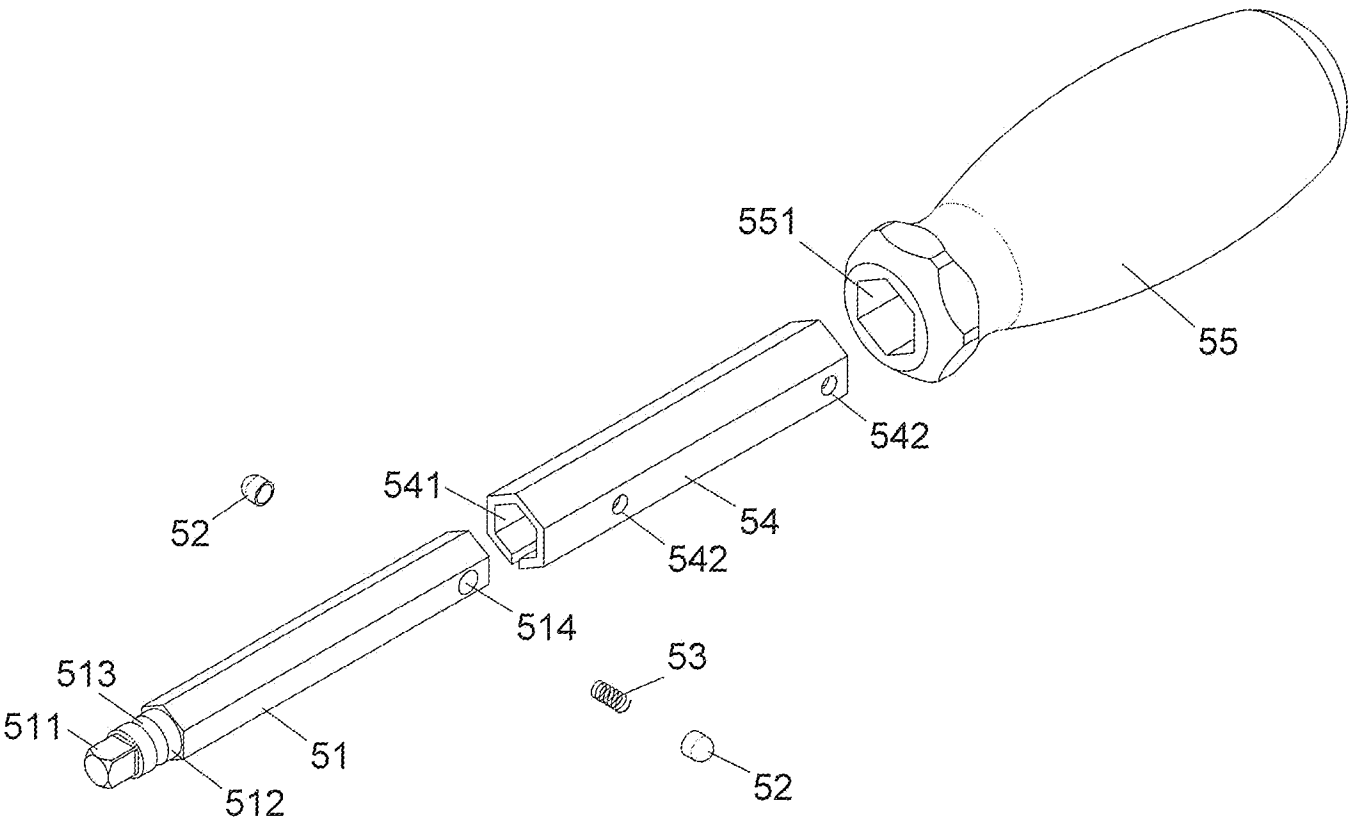
FIG. 6 is an exploded view to show the second rotary unit of the ratchet wrench of the present invention.
Figure 22:
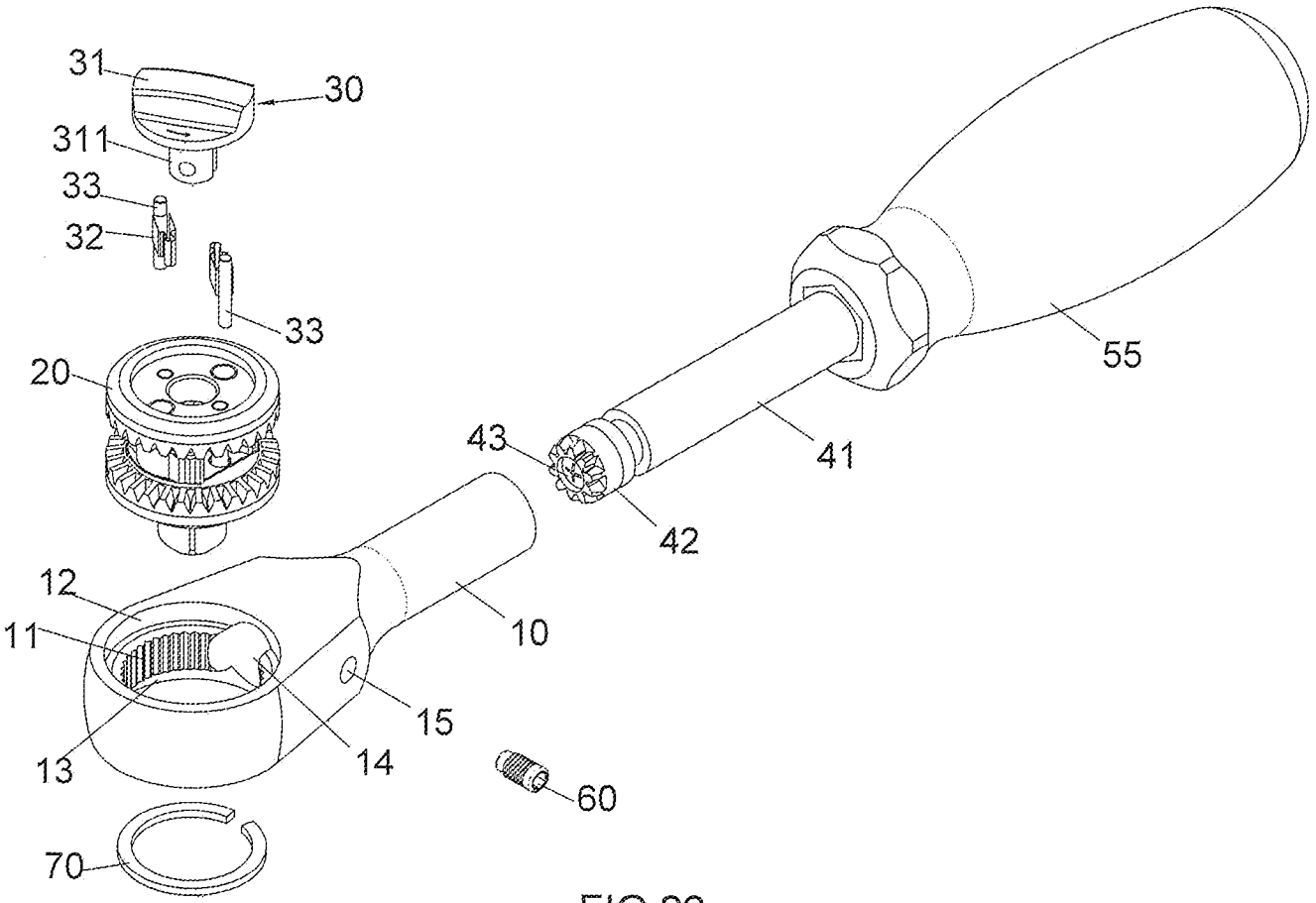
FIG. 22 is an exploded view to show the second embodiment of the ratchet wrench of the present invention.

As shown in FIG. 22, the second embodiment of the present invention does not have the sleeve 44, the first clip 45, the second resilient member 46, the bead 47 and the end piece 48 as shown in FIG. 4. In stead, the first rotary rod 41 of the first rotary unit 40 and the second rotary rod 51 of the second rotary unit 50 are integral to each other.

The benefits of the present invention are that, as shown in FIG. 11, when the sleeve 44 is at the engaged position, the bead 47 is pushed inward by the smaller inner diameter portion of the stepped recess 443, so that the bead 47 is engaged with the groove 513. The second rotary rod 51 is restricted by the bead 47 and is positioned at a specific position relative to the first rotary rod 41.

As shown in FIG. 14, when the handle 55 is pulled backward, the third rotary rod 54 moves, the second and third rotary rods 51, 54 are connected to each other to form a fixed length.

As shown in FIG. 17, when the sleeve 44 at the release position the larger inner diameter portion of the stepped recess 443 accommodates the bead 47 which is removed from the groove 513 of the second rotary rod 51 so that the second and first rotary rods 51, 41 are free of restriction. As shown in FIG. 18, when the sleeve 44 is moved forward to the release position, the second and first rotary rods 51, 41 are separated from each other. The second rotary unit 50 can be connected to other hand tool.

While we have shown and described the embodiment in accordance with the present invention, it should be clear to those skilled in the art that further embodiments may be made without departing from the scope of the present invention.

What is claimed is:

1. A ratchet wrench comprising:

an elongate body having an extension which has a working end on one end thereof, the working end having a through hole which has a first toothed portion defined in an inner periphery thereof, a first space and a second space respectively and co-axially located on a top and a bottom of the through hole, a diameter of the first space and a diameter of the second space being larger than that of the first toothed portion, the extension having a first recess defined axially therein which communicates with the first toothed portion, the body having a restriction portion defined in a side thereof and the restriction portion communicating with the first recess;

a driving unit pivotably connected in the working end;

a control unit for controlling the driving unit to rotate clockwise or counter clockwise;

a first rotary unit having a first rotary rod with a round cross section, a ring-shaped third toothed ring, a first connector, a sleeve, a C-shaped first clip, a second resilient member and a bead, the first rotary rod being pivotably located in the first recess and having a protrusion with at least a non-circular portion extending from a first end thereof, a connection end with inner threads being defined in an end face of the protrusion, a first reception recess with at least a non-circular portion defined in a second end of the first rotary rod, the first rotary rod having a groove defined in an outside thereof, the groove of the first rotary rod located corresponding to the restriction portion, a second reception recess defined in the second end of the first rotary rod and communicating with the first reception recess, a bead receiving hole and another groove defined in the outside of the first rotary rod, the bead receiving hole located corresponding to the second reception recess, said another groove located corresponding to the first reception recess, the third toothed ring mounted to the protrusion and having a third toothed portion on an end thereof, the first connector having outer threads and extending through the third toothed ring and being threadedly connected to the connection end, the sleeve being axially mounted to the first rotary rod and moved between a release position and an engaged position, the sleeve having a receiving recess defined therein which extends through a first open end of the sleeve, a stepped recess defined in a second end of the sleeve and communicating with the receiving recess, the stepped recess being wider from the first end toward the second end of the sleeve, the stepped recess located corresponding to the second reception recess, a shoulder formed in the sleeve and located between the stepped recess and the receiving recess, the first clip engaged with said another groove and located within the receiving recess, an outer periphery of the first clip being protruding from an outer surface of the first rotary rod, the first clip being in flush with the sleeve, the second resilient member mounted to the first rotary rod and located within the receiving recess, the second resilient member being biased between the shoulder and the first clip so that the second resilient member provides a force move the sleeve between the release position and the engaged position, the bead being a spherical bead and located in the bead receiving hole and being restricted by the stepped recess so as not drop from the bead receiving hole which has a periphery which prevents the bead from dropping into the second reception recess;

a second rotary unit having a second rotary rod which has a cross section with at least a non-circular portion, two caps, a third resilient member, a third rotary rod which has a cross section with at least a non-circular portion and a handle, the second rotary rod having a first reception portion and a second reception portion on a first end thereof, the second reception portion being a cylindrical portion, a hole defined transversely through a second end of the second rotary rod, the first reception portion engaged with the first reception recess, the second reception portion received in the second reception recess, the second reception portion having a groove which is located corresponding to the bead receiving hole, the bead engaged with the groove of the second reception portion, the second rotary rod being restricted by the bead to engage the second reception portion with the second reception recess, the third resilient member and the two caps located in the hole of the second rotary rod, the third resilient member being biased between the two caps, the two caps partially protruding from two ends of the hole of the second rotary rod, the third rotary rod having a first passage defined through two open ends thereof, the first passage being engaged with the second end of the second rotary rod, the third rotary rod having multiple holes defined along the third rotary rod, the holes in the third rotary rod being circular holes, the hole of the second rotary rod being located corresponding to one of the holes in the third rotary rod so that the caps are engaged with the holes of the third rotary rod so as to adjust a position of the third rotary rod relative to the second rotary rod, the handle having a second passage defined in one end thereof, one end of the third rotary rod being engaged with the second passage, and a second connector connected to the restriction portion and movably engaged with the groove of the third rotary rod, the second connector restricting the first rotary rod from dropping from the first recess.

2. The ratchet wrench as claimed in claim 1, wherein the restriction portion is a circular hole and has inner threads, the second connector has outer threads which are threadedly connected to the inner threads of the restriction portion.

3. The ratchet wrench as claimed in claim 1, wherein the driving unit comprises a cylindrical lower part, an annular seat, an annular first toothed ring, two first rods, two second rods, two first pawls, an annular second toothed ring and a cylindrical top part, the lower part has two first connection portions and two second connection portions, the two first connection portions and the two second connection portions are upright holes, the lower part has two first faces which are flat faces and located on two opposite sides of the lower part, the seat is mounted to the lower part, an inner diameter of an inner periphery of the seat is the same as that of the lower part, an outer diameter of the seat is larger than that of the lower part, the first toothed ring is mounted to the lower part and rested on the seat, the first toothed ring has first teeth defined in an outer periphery thereof, an inner periphery of the first toothed ring faces the first faces so as to form two rooms defined by the two first faces and the inner periphery of the first toothed ring, the first rods are inserted in the first connection portions, the first rods are two cylindrical rods, the second rods are inserted in the second connection portions, the second rods are cylindrical rods, the two first pawls are connected to a top of the lower part and each of the two first pawls has engaging teeth which are engaged with the first toothed portion, each of the two first pawls has a first hole, the first rod extends through the first hole, the second toothed ring has second teeth which are located corresponding to the first teeth of the first toothed ring, the second toothed ring has a second inner periphery, the top part is located corresponding to the lower part, the second toothed ring is mounted to the top part, the top part has two third connection portions and two fourth connection portions, the third connection portions and the two fourth connection portions are respectively located corresponding to the first connection portions and the second connection portions, the two third connection portions are mounted to the first rods, the two fourth connection portions are mounted to the second rods, the top part has two second faces located on two opposite sides thereof, the two second faces are located corresponding to the first faces, the top part has a second hole defined centrally therethrough.

4. The ratchet wrench as claimed in claim 3, wherein a diameter of the first connection portion is larger than that of the second connection portion.

5. The ratchet wrench as claimed in claim 3, wherein the lower part is a rectangular driving portion.

6. The ratchet wrench as claimed in claim 3, wherein the control unit has a switch, two first resilient members and two pins, the switch has a cylindrical switch rod which is pivotably connected to the second hole, the switch rod has a recessed portion defined in each of two sides thereof, a top of the switch protrudes from the body, each first resilient member is pivotably connected to the second rod corresponding thereto, the first resilient member has one end pivotably connected to the switch rod, each of the first resilient members has a protruding end and an open end, each of the pins is engaged with the open end of the first resilient member corresponding thereto, the pin is located in the room of the lower part, one end of each pin is located between the first face and the inner periphery of the seat, the other end of each pin is located between the second inner periphery and the second face, when the switch is rotated to pivot the first pawl about the first rod, and to drive the first resilient member, the first resilient member moves the pin within the room.

7. The ratchet wrench as claimed in claim 3, wherein the third toothed portion is located between the first teeth and the second teeth, the third toothed portion is engaged with the first teeth and the second teeth.

8. The ratchet wrench as claimed in claim 3 further comprising a C-shaped second clip which is mounted to the lower part to prevent the driving unit from dropping the body.

9. The ratchet wrench as claimed in claim 1, wherein the first reception recess is a rectangular recess, the first reception portion is a rectangular protrusion.

10. The ratchet wrench as claimed in claim 1, wherein the first reception recess is a hexagonal recess, the first reception portion is a hexagonal protrusion.

11. The ratchet wrench as claimed in claim 1, wherein the sleeve has multiple ridges for increasing friction.

12. The ratchet wrench as claimed in claim 1, wherein the first rotary unit has an annular end piece which is mounted to the first rotary rod and located between the first rotary rod and the stepped recess, the end piece seals an open end of the stepped recess, the end piece is in flush with the second end of the first rotary rod.

13. The ratchet wrench as claimed in claim 1, wherein each of the second and third rotary rods has a hexagonal cross section, the first and second passages each are a hexagonal passage, there are two holes in the third rotary rod.

14. The ratchet wrench as claimed in claim 1, wherein the first and second reception recesses are defined in the second rotary rod, the first and second reception portions and the groove are defined in the first rotary rod, the sleeve, the first clip, the second clip, the bead and the end piece are connected to outside of the second rotary rod.

* * * * *